US011229309B2

(12) United States Patent
Hart et al.

(10) Patent No.: US 11,229,309 B2
(45) Date of Patent: Jan. 25, 2022

(54) AUTOMATICALLY OPENING AND CLOSING INFLATABLE HOLIDAY ORNAMENT

(71) Applicants: Laura Ann Hart, Collegeville, PA (US); Justin Aiello, Kennebunk, ME (US)

(72) Inventors: Laura Ann Hart, Collegeville, PA (US); Justin Aiello, Kennebunk, ME (US)

(73) Assignee: Holiday Hideables, LLC, Collegeville, PA (US)

( * ) Notice: Subject to any disclaimer, the term of this patent is extended or adjusted under 35 U.S.C. 154(b) by 0 days.

(21) Appl. No.: 17/186,108

(22) Filed: Feb. 26, 2021

(65) Prior Publication Data

US 2021/0267402 A1 Sep. 2, 2021

Related U.S. Application Data

(60) Provisional application No. 62/982,297, filed on Feb. 27, 2020.

(51) Int. Cl.

| | |
|---|---|
| ***A47G 33/00*** | (2006.01) |
| ***A63H 3/06*** | (2006.01) |
| ***B66D 1/30*** | (2006.01) |
| ***B66D 1/36*** | (2006.01) |
| ***B66D 1/34*** | (2006.01) |
| ***B66D 1/60*** | (2006.01) |

(Continued)

(52) U.S. Cl.

CPC ..... *A47G 33/00* (2013.01); *A63H 3/06* (2013.01); *A63H 3/36* (2013.01); *A63H 33/40* (2013.01); *B66D 1/00* (2013.01); *B66D 1/30* (2013.01); *B66D 1/34* (2013.01); *B66D 1/365* (2013.01); *B66D 1/40* (2013.01); *B66D 1/48* (2013.01); *B66D 1/485* (2013.01); *B66D 1/60* (2013.01); *B66D 1/64* (2013.01); *F04B 35/00* (2013.01); *F04B 35/01* (2013.01); *F04B 35/04* (2013.01); *F21V 3/026* (2013.01)

(58) Field of Classification Search

CPC ..... A63H 3/06; A63H 3/36; A63H 37/00
USPC ..... 446/220, 226, 310, 311
See application file for complete search history.

(56) References Cited

U.S. PATENT DOCUMENTS 4,903,958 A * 2/1990 DiCarlo ..... A63H 27/10 116/210
4,920,674 A * 5/1990 Shaeffer ..... A63H 27/10 116/210

(Continued)

*Primary Examiner* — Joseph B Baldori
(74) *Attorney, Agent, or Firm* — Joseph E. Maenner; Petock & Petock LLC

(57) ABSTRACT

An automatically opening and closing inflatable holiday ornament includes a box that has a base, a plurality of side panels hingedly connected to the base, and a top portion connected to each of the plurality of side panels. The ornament further includes a motor, a plurality of pull cables, such that each of the plurality of pull cables has a first end operatively connected to the motor and a second end connected to one of the plurality of side panels. The ornament also includes a first blower, an inflatable disposed in the box and surrounding the first blower such that operation of the first blower blows air into the inflatable to inflate the inflatable, and a controller operatively connected to the motor and to the first blower such that the controller controls operation of the motor and the blower.

19 Claims, 7 Drawing Sheets

(51) Int. Cl.

| | |
|---|---|
| ***B66D 1/40*** | (2006.01) |
| ***A63H 3/36*** | (2006.01) |
| ***B66D 1/00*** | (2006.01) |
| ***B66D 1/48*** | (2006.01) |
| ***A63H 33/40*** | (2006.01) |
| ***B66D 1/64*** | (2006.01) |
| *F04B 35/01* | (2006.01) |
| *F04B 35/00* | (2006.01) |
| *F04B 35/04* | (2006.01) |
| *F21V 3/02* | (2006.01) |

(56) References Cited

U.S. PATENT DOCUMENTS 5,120,263 A * 6/1992 Ierfino ..... A63H 37/00 273/459
5,293,707 A * 3/1994 Shaeffer ..... A63H 27/10 40/214
5,542,870 A * 8/1996 Westersund ..... A63H 33/062 220/324
5,935,013 A * 8/1999 McLennan ..... A63H 27/10 472/54
6,001,019 A * 12/1999 Al-Bannai ..... A23G 3/28 446/148
6,148,551 A * 11/2000 Glass ..... G09F 21/08 40/214
6,238,067 B1 * 5/2001 Hirsch ..... A63H 27/10 362/231
6,312,308 B1 * 11/2001 Chen ..... A47G 33/06 40/410
6,373,384 B1 * 4/2002 Ferguson ..... G08B 5/002 116/210
6,468,126 B1 * 10/2002 Herber ..... A63H 13/16 446/308
6,804,905 B1 * 10/2004 Burger, III ..... G09F 15/0025 40/212
7,008,289 B2 * 3/2006 Norman ..... A63H 3/18 446/308
7,197,841 B2 * 4/2007 Hsu ..... G09F 15/0025 40/212
7,597,209 B2 * 10/2009 Rothschild ..... A45C 7/0036 220/23.87
8,296,881 B2 * 10/2012 Litman ..... A63H 33/003 5/420
9,583,022 B2 * 2/2017 Brown ..... G09B 19/0076
10,328,354 B2 * 6/2019 Bushell ..... B65D 5/5014
10,653,219 B2 * 5/2020 Camburn ..... A45C 7/00
10,717,016 B2 * 7/2020 McDonald ..... A63H 3/18
2008/0233831 A1 * 9/2008 Hsu ..... F04D 29/4246 446/220
2019/0318673 A1 * 10/2019 Newton ..... G09F 19/02

* cited by examiner

AUTOMATICALLY OPENING AND CLOSING INFLATABLE HOLIDAY ORNAMENT

CROSS-REFERENCE TO RELATED APPLICATION

The present application claims the benefit of U.S. Provisional Patent Application Ser. No. 62/982,297, filed on Feb. 27, 2020, which is incorporated herein by reference in its entirety.

BACKGROUND OF THE INVENTION

Field of the Invention

The invention relates to holiday decorations that automatically open to reveal and inflate an inflatable ornament and close to deflate and hide the deflated ornament.

Description of the Related Art

Christmas holiday decorations often include inflatable yard decorations that are inflated via an electrically operated blower. When the blower is turned off, the decoration deflates, leaving an unsightly deflated decoration in the yard. Additionally, the deflated decoration can be blown by winds and possibly tear.

It would be beneficial to provide an inflatable yard decoration that, when not inflated, does not sit in the open in a deflated condition and look unsightly.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an automatically opening and closing inflatable holiday ornament that includes a box having a base, a plurality of side panels hingedly connected to the base, and a top portion connected to each of the plurality of side panels. The ornament further includes a motor, a plurality of pull cables, such that each of the plurality of pull cables has a first end operatively connected to the motor and a second end connected to one of the plurality of side panels. The ornament also includes a first blower, an inflatable disposed in the box and surrounding the first blower such that operation of the first blower blows air into the inflatable to inflate the inflatable, and a controller operatively connected to the motor and to the first blower such that the controller controls operation of the motor and the blower.

In an alternative embodiment, the present invention is an automatically opening and closing inflatable holiday ornament comprising a box configured to operate between a closed position wherein side panels of the box are in a vertical position and an open position wherein the side panels are away from the vertical position. An inflatable is disposed inside the box when the box is in the closed position and extending upwardly from the box when the box is in the open position. A motor is configured to move the side panels between the vertical position and the away from the vertical position. A first blower is inside the box and is configured to inflate the inflatable when the side panels are moved to the away from the vertical position.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
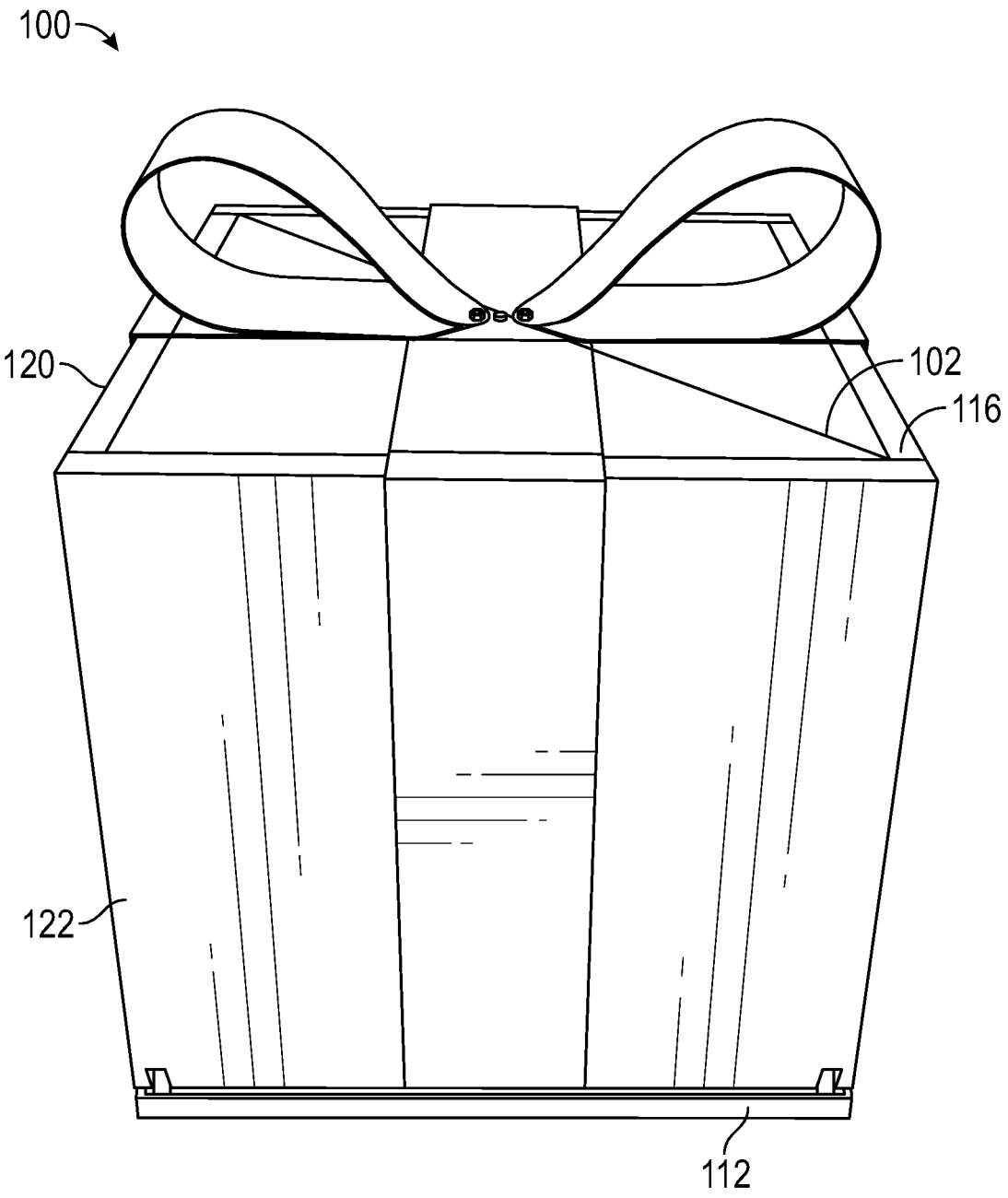
FIG. 1 is a perspective view of an inflatable ornament according to an exemplary embodiment of the present invention, in a closed position.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Figure 2:
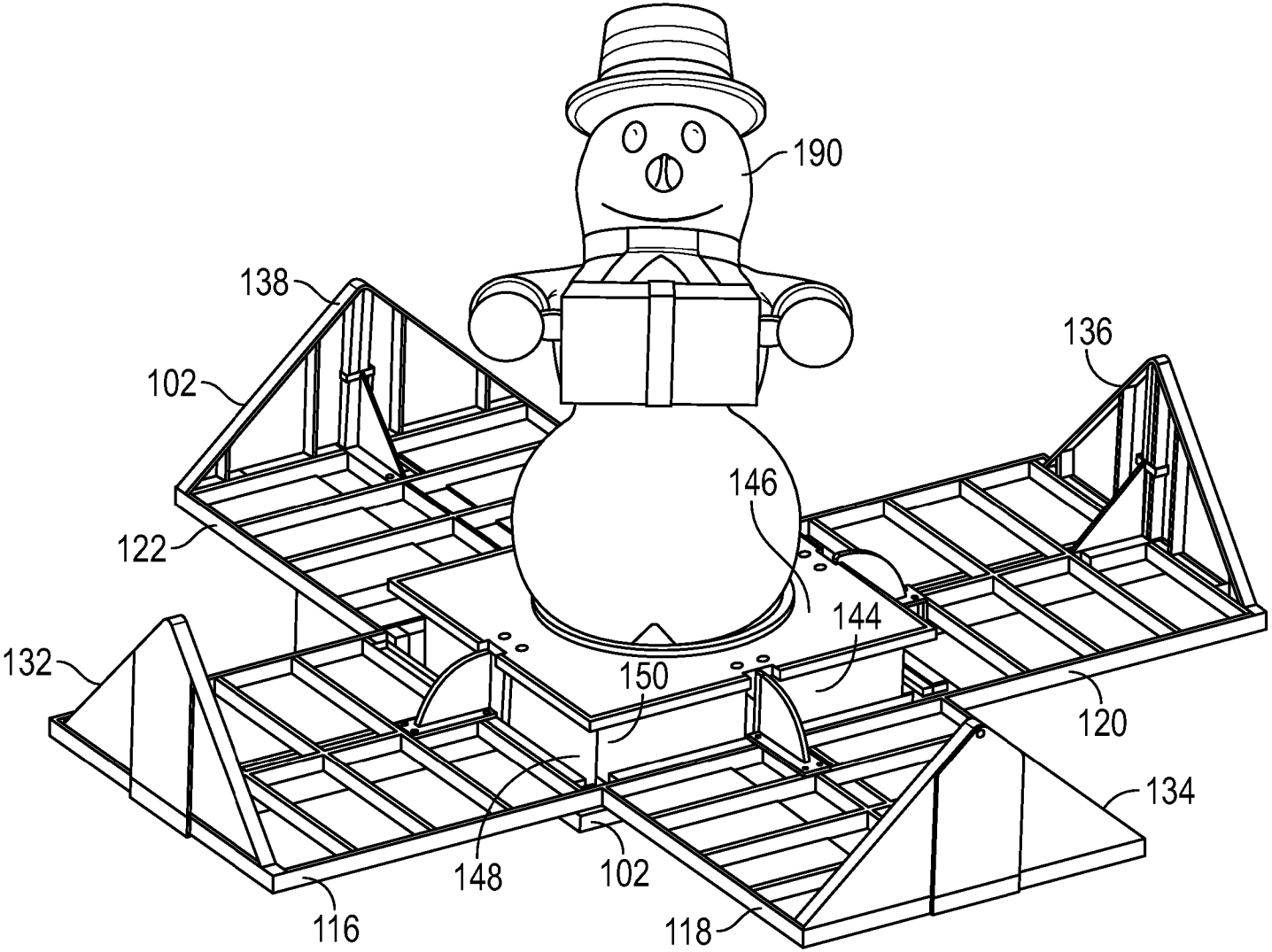
FIG. 2 is a perspective view of the inflatable ornament of FIG. 1, in an open position, with the inflatable inflated.
Figure 3:
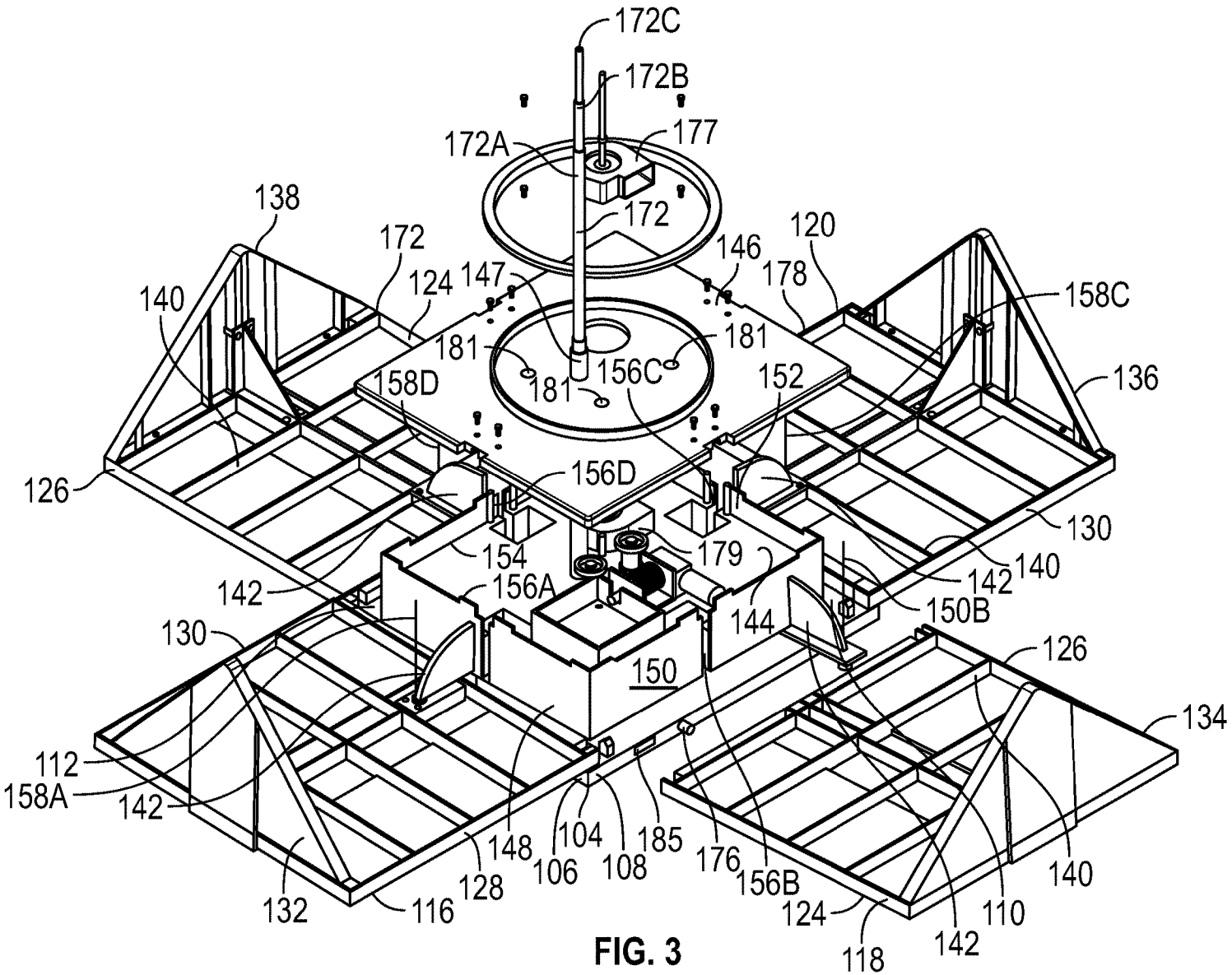
FIG. 3 is an exploded view of the ornament of FIG. 1.

The present invention is an automatically opening and closing inflatable holiday ornament 100 ("ornament 100"). Ornament 100 can be used outdoors, such as on a lawn, or other suitable location. Referring to FIGS. 1-3, ornament 100 can include a box 102 or other suitable shape that houses an inflatable inflatable 190, shown in FIG. 2. When inflatable 190 is deflated, inflatable 190 is stored in box 102 and is not visible, as shown in FIG. 1. When inflatable 190 is inflated, box 110 automatically opens and inflatable 190 emerges from box 102, as shown in FIG. 2.

Referring to FIG. 3, box 102 includes a base 104 with a plurality of edges 106, 108, 110, 112. A like plurality of panels 116, 118, 120, 122 are hingedly connected to a respective one of the sides 106, 108, 110, 112. Panels 116, 118, 120, 122 are located relative to base 104 such that, when box 102 is closed, side edge 124, 126 of panel 118 and side 122 are exposed, while side edges 128, 130 of sides 116, 120 are covered by panels 118, 122.

A generally triangular top portion 132, 134, 136, 138 extends orthogonally from each respective panel 116, 118, 120, 122 such that, when panels 116, 118, 120, 122 are in a closed position forming box 102, top portions 132, 134, 136, 138 engage each other to form a rectangular or square top, making box 102 appear to have a lid. Optionally, ornamentation, such as bows, or parts of bows, can be affixed to any of top portions 132, 134, 136, 138 so that, when panels 116, 118, 120, 122 are in the closed position, box 102 appears to have a bow on it, as shown in FIG. 1.

An interior of each panel 116, 118, 120, 122 includes a plurality of ribs 140 that provide structural support for a respective panel 116, 118, 120, 122. Each panel 116, 118, 120, 122 also includes an operating tab 142 mounted toward the bottom of each respective panel 116, 118, 120, 122. Operating tabs 142 are used to lift panels 116, 118, 120, 122 to close box 102.

Referring to FIG. 3, a central compartment 144 is mounted on base 104. Compartment 130 includes a removable lid 146 and a like plurality of sides 148, 150, 152, 154 to panels 116, 118, 120, 122 that extend parallel to each respective side.

Each side 148, 150, 152, 154 includes a through-slot 156A, 156B, 156C, 156C, respectively, that allows a pull cable 158A, 158B, 158C, 158D to extend through to attach to operating tab 142 on a respective panel 116, 118, 120, 122.

Figure 4:
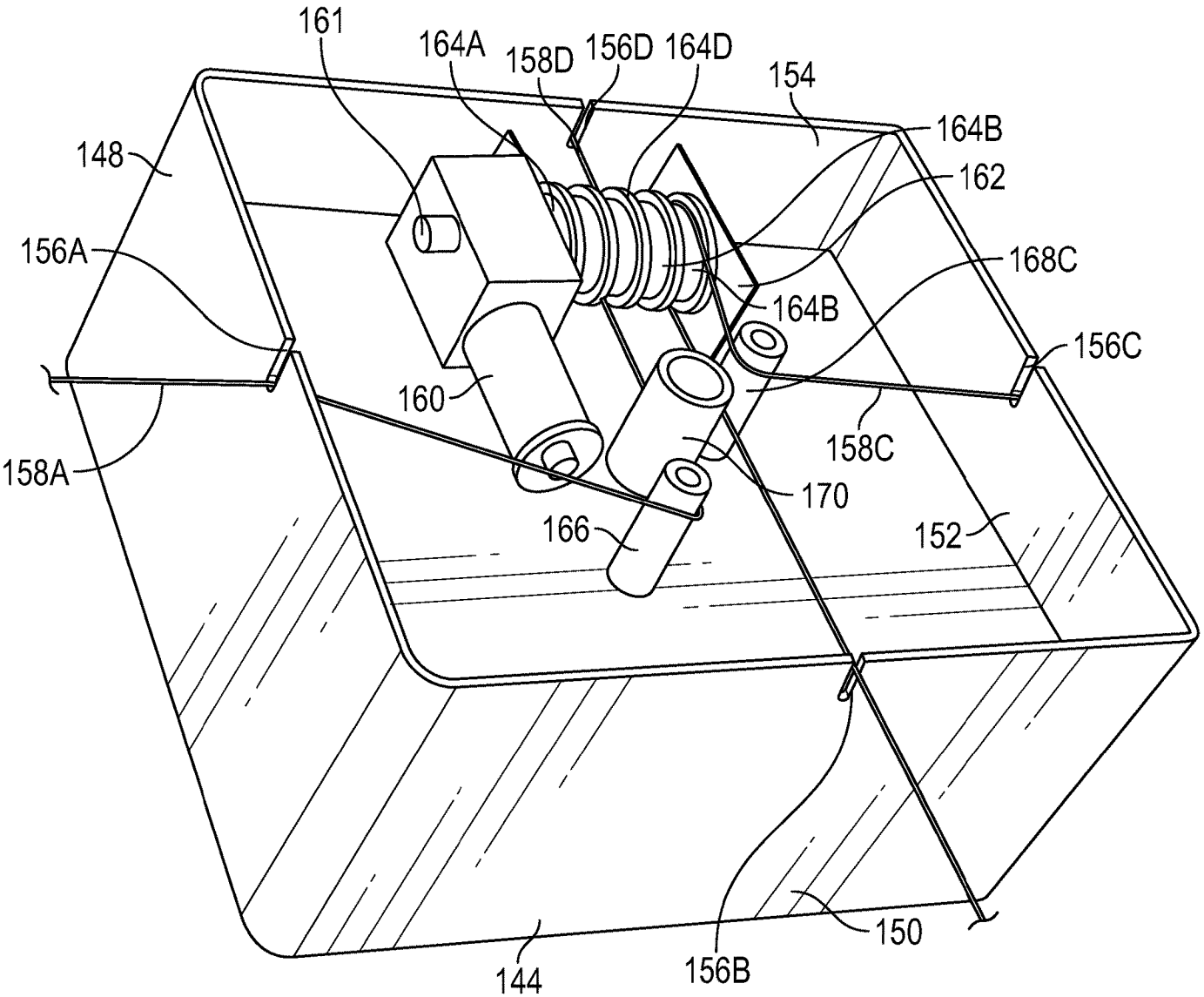
FIG. 4 is a perspective view of the central compartment of the ornament of FIG. 3, with the cover removed.

Referring to FIG. 4, a motor 160 is mounted in compartment 144 and is operated in a first direction is used to pull cables 158A-D inward to raise and close panels 116, 118, 120, 122 to the vertical position (shown in FIG. 1). Motor 160 can also be operated in a reverse direction to lower and open panels 116, 118, 120, 122 away from the vertical position with the aid of inflating inflatable 190. Motor 160 operatively engages a gear (not shown) inside a gearbox 161. A reel assembly 162 is connected to the gear such that, when motor 160 rotates, reel assembly 162 rotates as well. Reel assembly 162 supports a plurality of reels 164A, 164B, 164C, 164D such that each cable 158A-D is wound on a respective reel 164A-D.

Figure 5:
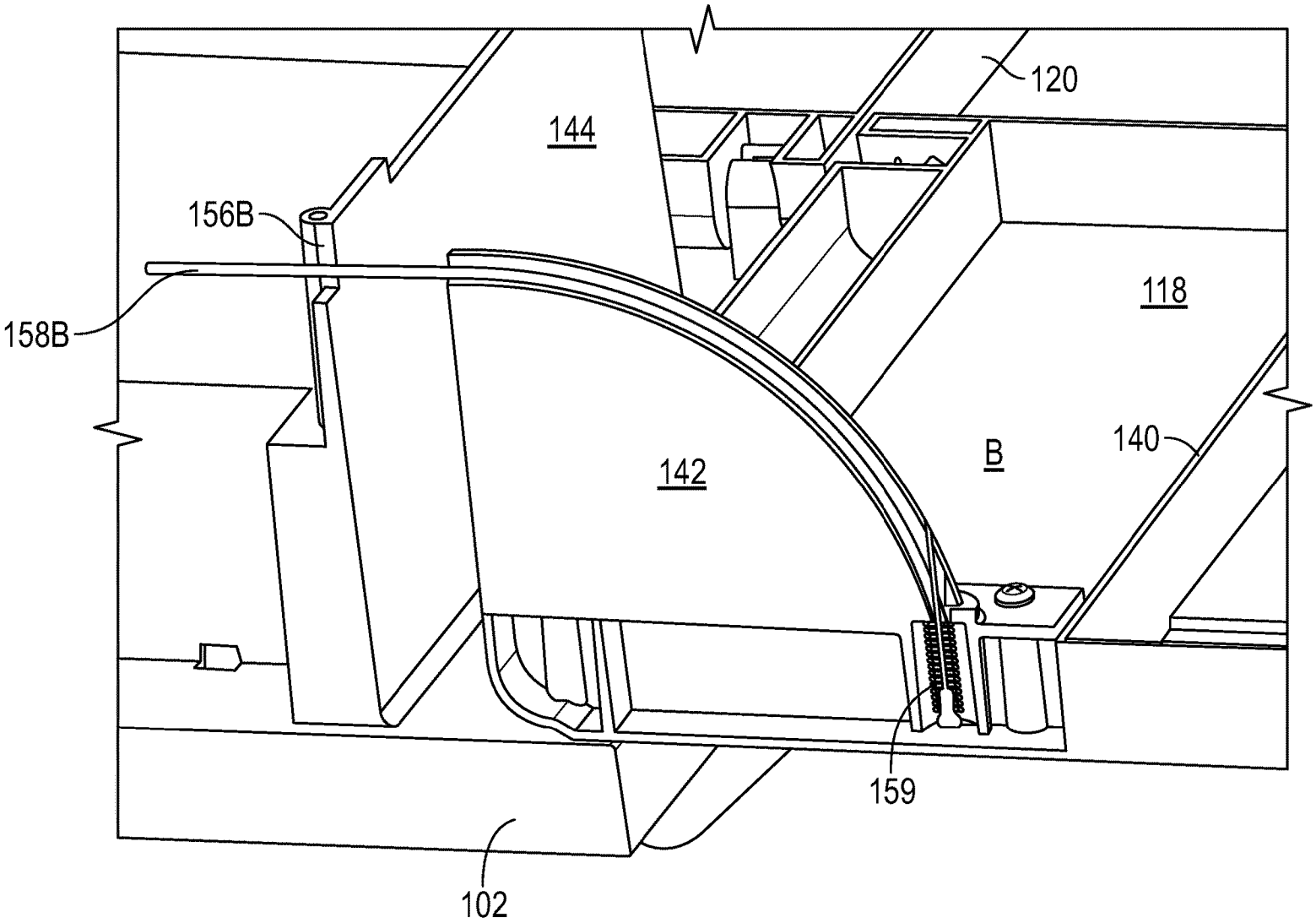
FIG. 5 is an enlarged perspective view of an operating tab with cable used to raise and lower a side wall of the ornament of FIG. 1.

A first end of each cable 158A-D is attached to a respective one of reels 164A-D and, referring to FIG. 5, a spring 159 is located at a second end of each cable 158A-D. Spring 159 is configured to dampen the motion of each side panel 116, 118, 120, 122 when the side panels 116, 118, 120, 122 are being raised and lowered.

Referring back to FIG. 4, an idler pulley 166, associated with cable 158A and reel 160A, is offset from the center of compartment 144 such that idler pulley 166 changes the direction of travel of cable 158A by 90 degrees so that cable 158A can pass through slot 156A to side 116. Similarly, an idler pulley 168C, associated with cable 158C and reel 160C, is offset from the center of compartment 144 such that idler pulley 168 changes the direction of travel of cable 158C by 90 degrees so that cable 158C can pass through slot 156C to side 120. Cable 158B extends straight through slot 156B to side 118 and cable 158D extends straight through slot 156D to side 122.

A central post 170 is extends upwardly from the center of compartment 144.

Central post 170 supports a telescoping pole 172, shown in FIG. 3. Pole 172 has three sections 172A, 172B, 172C, with the top of section 172C being attached to the top of inflatable 190. Lid 146 has a post 147 with a central through-opening to allow section 172A to extend therethrough and into central post 170.

Figure 6:
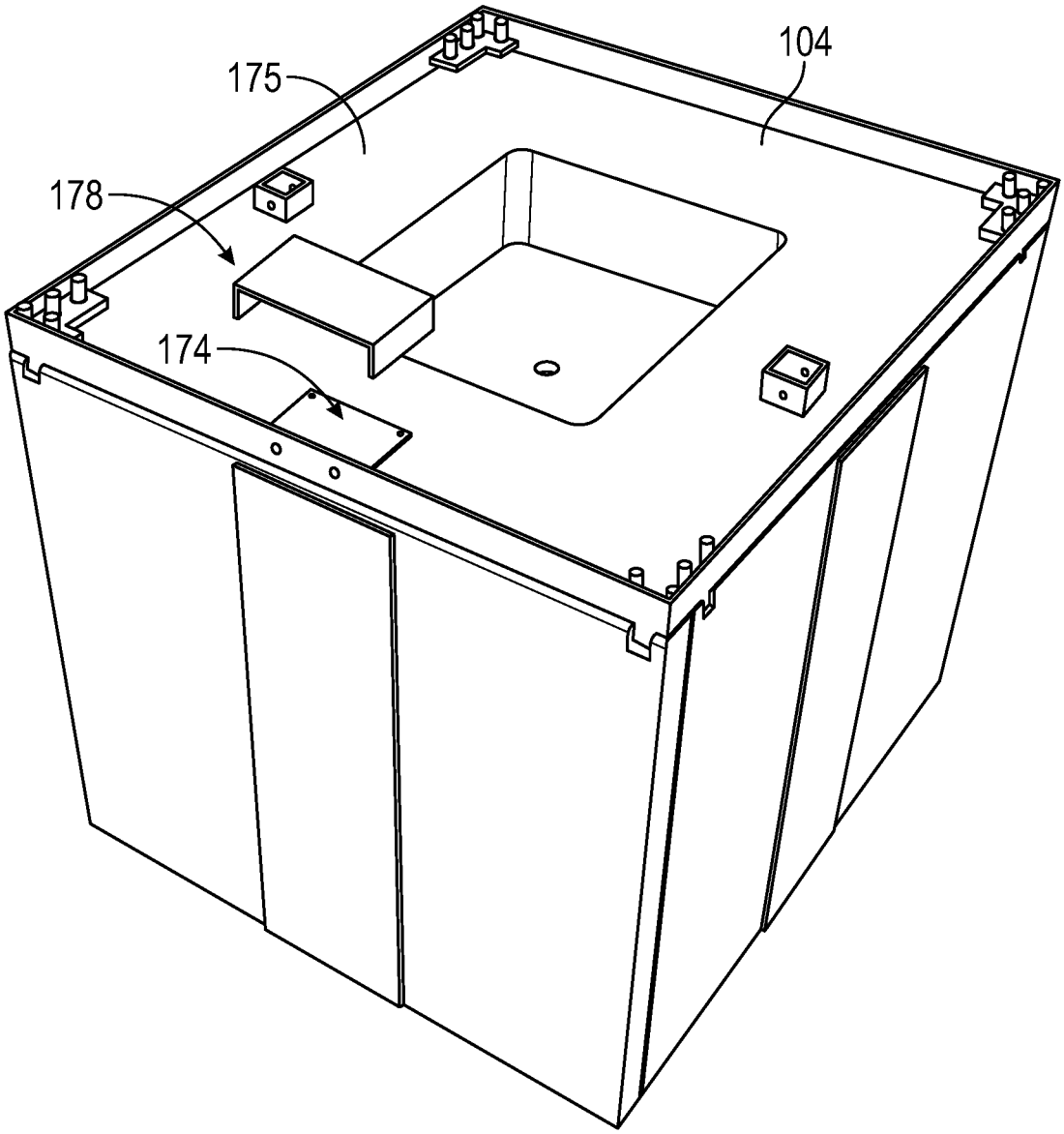
FIG. 6 is a bottom perspective view of the ornament of FIG. 1.

A first blower 177 can be mounted on top of lid 146 and has a blower discharge in fluid communication with inflatable 190. When the first blower 177 operates, air from the blower inflates inflatable 190. A deflate (second) blower 179 can also be mounted inside base 104 and has a blower discharge in fluid communication with inflatable 190 such that, when the second blower 179 operates, air is drawn from inflatable 190 to deflate inflatable 190. Operation of the blowers 177, 179 is controlled by a controller 174. Referring to FIG. 6, controller 174 is mounted on the underside 175 of base 104, and is covered by a removable cover 178.

Referring back to FIG. 3, a light strip 181 is mounted on top of compartment 144 inside inflatable 190 and illuminates when first blower 177 is activated and inflatable 190 is inflated. In an exemplary embodiment, light strip 181 can be plurality of LED lights, although those skilled in the art will recognize that light strip 181 can be other types of lights as well.

Figure 7:
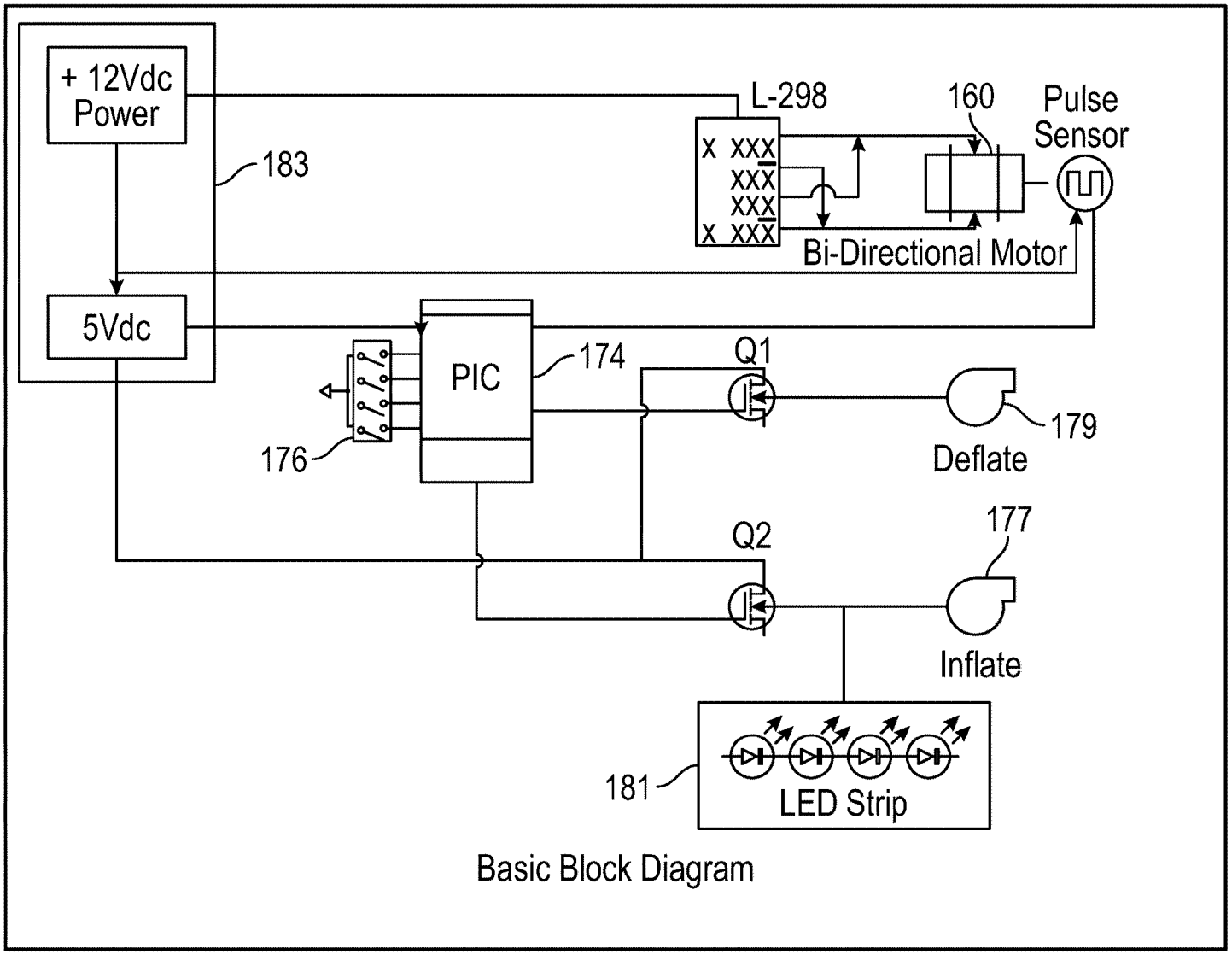
FIG. 7 is an electrical schematic drawing of the ornament of FIG. 1.

Referring to the electrical schematic of FIG. 7, ornament 100 includes an external switch 176 to select operation of ornament 100. Switch 176 can have four positions. In an exemplary embodiment, switch 176 can be a four-position rotary switch. Alternatively, switch 176 can be a four-position slide switch. Electrical power supply 183 can be provided by a 12V DC supply to operate motor 160. Power supply 183 can be stepped down to 5 V DC to operate blowers 177, 179 and light strip 181. Referring to FIG. 3, a plugin 185 can be part of base 102 to allow external electrical power to be provided to ornament 100.

When electrical power is applied to controller 174, controller 174 looks for the position of the switch 176 to select the mode of operation:

Switch Position/Mode 1 OFF: No action is taken.

Switch Position/Mode 2 ON:

Sequence of events:

1. Power is applied to motor 160 in the open direction to allow side panels 116, 118, 120, 122 to open.

2. While the motor 160 is driving the side panels 116, 118, 120, 122 open, a pulse wheel is being read by a Hall Effect sensor and a pulse count stored in controller 174. This allows controller 174 to know where the side panels 116, 118, 120, 122 are.

3. Current to the motor 160 is being monitored to ensure there is no overcurrent condition. If over current is sensed, then the drive to the motor 160 is disabled.

4. After reaching a pre-determined Pulse Count, the controller 174 turns off motor 160.

5. Inflate (first) blower 177 is turned on and the LED strip 181 is turned on. The display will remain in this ON state until the switch 176 is moved to a different position.

Switch Position Mode 3/4 Timed:

Sequence of events:

1. Power is applied to the 12Vdc bi-directional motor 160, through the L-298 in the open direction to allow the box sides to open.

2. While the motor 160 is driving the side panels 116, 118, 120, 122 open, a pulse wheel is being read by the Hall Effect sensor and a pulse count stored in NVRAM. This allows the PIC to know where the sides are.

3. Current to the motor 160 is being monitored to ensure there is no overcurrent condition. If over current is sensed the drive to the motor 160 is disabled.

4. After reaching a pre-determined Pulse Count, the PIC turns off the drive motor 160.

5. Inflate blower 177 is turned on and the LED strip 181 is turned on.

6. An internal timer is started to keep track of elapsed time.

7. Upon reaching a pre-determined threshold, 4 hours for switch position 3, 6 hours for switch position 4, controller 174 enters shut down mode.

Shut Down Mode:

Sequence of events:

1. The inflate blower 177 is turned off. The LED strip 181 is turned off.

2. The deflate blower 179 is turned on to remove all the air from the inflatable 190.

3. A timer is started to allow the deflate blower 179 to remain on for a pre-determined amount of time to ensure complete deflation.

4. One the threshold of time is reached the deflate blower 179 is turned off.

5. Power is applied to the 12Vdc bi-directional motor 160 through the L-298 in the close direction to allow side panels 116, 118, 120, 122 to close.

6. While the motor 160 is driving side panels 116, 118, 120, 122 closed, a pulse wheel is being read by the Hall Effect sensor and a pulse count stored in NVRAM and compared to a set value. This allows the PIC to know when side panels 116, 118, 120, 122 are completely closed.

7. Current to the motor 160 is being monitored to ensure there is no overcurrent condition. If over current is sensed the drive to the motor 160 is disabled.

8. After reaching a pre-determined Pulse Count, controller 174 turns off the drive motor 160.

If controller 174 is ON and the switch 176 is moved to one of the timed modes, the timer is started, and operation will continue as though it was started in a timed mode.

To operate ornament 100 directly, a user selects a time duration of switch 176 and moves switch 176 to the appropriate "ON" position, starting the inflate blower 177. Inflatable 190 inflates and expands beyond the confines of box 102, forcing panels 116-122 to open, allowing inflatable 190 to rise above box 102. Pole sections 172A-C telescope, guiding inflatable 190 upward and fully inflating inflatable 190. Blower 179 remains on for the time duration selected by switch 176.

After the time duration expires, controller 174 cuts off electrical power to the inflate blower 177 and the blower 177 shuts off. Deflate blower 179 turns on and inflatable 190 deflates and, as inflatable 190 deflates, the weight of inflatable 190 forces pole sections 172A-C to collapse into their adjacent pole sections 172A-C. After inflatable 190 is fully collapsed, controller 174 transmits a signal to motor 160 to operate to wind reel assembly 162 to pull in cables 158A-D, which in turn pull up panels 116-122 to close box 102. After box 102 is closed, controller 174 transmits a signal to motor 160 to stop.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. An automatically opening and closing inflatable holiday ornament comprising:

a box comprising:

a base;

a plurality of side panels hingedly connected to the base; and a top portion connected to each of the plurality of side panels;

a motor housed in a compartment having a plurality of through-slots formed therein;

a reel assembly rotatably mounted on the motor, the reel assembly having a plurality of reels mounted thereon;

a plurality of pull cables, each of the plurality of pull cables having a first end operatively connected to a respective one of the plurality of reels and a second end connected to one of the plurality of side panels such that operation of the motor simultaneously pulls all of the plurality of cables, thereby lifting the plurality of side panels, wherein each of the plurality pull cables extends through one of the plurality of through-slots;

a first blower;

an inflatable disposed in the box and surrounding the first blower such that operation of the first blower blows air into the inflatable to inflate the inflatable; and a controller operatively connected to the motor and to the first blower such that the controller controls operation of the motor and the blower.

2. The automatically opening and closing inflatable holiday ornament according to claim 1, further comprising a central post disposed in the box and inside the inflatable such that, when the inflatable inflates, the central post telescopically extends.

3. The automatically opening and closing inflatable holiday ornament according to claim 1, wherein the top portion connected to each of the plurality of side panels is triangular in shape.

4. The automatically opening and closing inflatable holiday ornament according to claim 1, wherein the motor comprises an output shaft having a plurality of reels mounted thereon and wherein the first end of each of the plurality of cables is wound around one of the plurality of reels.

5. The automatically opening and closing inflatable holiday ornament according to claim 4, further comprising first and second idler pulleys such that a first of the plurality of cables wraps at least partially around the first idler and a second of the plurality of cables wraps around the second idler pulley.

6. The automatically opening and closing inflatable holiday ornament according to claim 1, wherein the motor operates to alternately raise and lower the side panels.

7. The automatically opening and closing inflatable holiday ornament according to claim 6, further comprising a spring located at the second end of each cable, the spring configured to dampen the motion of each side panel when the side panels are being raised and lowered.

8. The automatically opening and closing inflatable holiday ornament according to claim 1, wherein the controller is configured to control operation of the ornament alternately in four configurations:

(a) off;

(b) operating the first blower for a first amount of time;

(c) operating the first blower for a second amount of time; and (d) shutdown.

9. The automatically opening and closing inflatable holiday ornament according to claim 8, further comprising a second blower operatively connected to the controller such that operation of the second blower deflates the inflatable.

10. The automatically opening and closing inflatable holiday ornament according to claim 9, wherein configuration (d) comprises operating the second blower.

11. The automatically opening and closing inflatable holiday ornament according to claim 10, wherein the motor operates in a first direction in configurations (b) and (c) and the motor operates in an opposing direction in configuration (d).

12. An automatically opening and closing inflatable holiday ornament comprising:

a box configured to operate between a closed position wherein side panels of the box are in a vertical position and an open position wherein the side panels are away from the vertical position;

an inflatable disposed inside the box when the box is in the closed position and extending upwardly from the box when the box is in the open position;

a motor configured to move the side panels between the vertical position and the away from the vertical position;

a plurality of cables, each of the plurality of cables connecting one of the side panels to the motor, wherein the plurality of pull cables comprises four pull cables, wherein the motor operates all of the plurality of cables, and wherein only two of the four pull cables are each redirected by a single pulley; and a first blower inside the box and configured to inflate the inflatable when the side panels are moved to the away from the vertical position, wherein the motor is housed in a compartment having a plurality of through-slots formed therein, each of the plurality of pull cables extending through one of the plurality of through-slots.

13. The automatically opening and closing inflatable holiday ornament according to claim 12, wherein the motor operates in a first direction to move the side panels from the vertical position and the away from the vertical position and a second direction, opposite from the first direction, to move the side panels from the away from the vertical position to the vertical position.

14. The automatically opening and closing inflatable holiday ornament according to claim 12, further comprising a second blower inside the box and configured to delate the inflatable when the side panels are moved toward the vertical position.

15. The automatically opening and closing inflatable holiday ornament according to claim 12, further comprising a plurality of lights inside the box and configured to illuminate when the inflatable is inflated.

16. The automatically opening and closing inflatable holiday ornament according to claim 12, wherein, when the wherein side panels of the box are in the vertical position, the inflatable is concealed from view.

17. The automatically opening and closing inflatable holiday ornament according to claim 12, further comprising a controller configured to operate the motor and the first blower.

18. The automatically opening and closing inflatable holiday ornament according to claim 17, further comprising a four-position switch electrically connected to the controller.

19. The automatically opening and closing inflatable holiday ornament according to claim 18, wherein the switch is configured to control operation of the ornament alternately in four configurations:

(a) off;

(b) operating the first blower for a first amount of time;

(c) operating the first blower for a second amount of time; and (d) shutdown.

* * * * *